US005341898A

United States Patent [19]

Baziuk

[11] Patent Number: 5,341,898

[45] Date of Patent: Aug. 30, 1994

[54] FOLDABLE BOOM FOR MOUNTING ON A ROOF OF A BUILDING

[76] Inventor: Morris Baziuk, Box 53, Group 6, R.R.#1, Winnipeg, Manitoba, Canada, R3C 4A3

[21] Appl. No.: 109,534

[22] Filed: Aug. 20, 1993

[51] Int. Cl.[5] ..... E04G 3/10; B66C 23/00

[52] U.S. Cl. ..... 182/142; 182/45; 212/187; 248/237

[58] Field of Search ..... 182/45, 142; 248/237; 212/179, 187, 182; 414/10; 187/2, 6, 7

[56] References Cited

U.S. PATENT DOCUMENTS

| | | | |
|---|---|---|---|
| 477,129 | 6/1892 | Laughton | 212/187 X |
| 494,473 | 3/1893 | Garrison | 212/182 |
| 628,592 | 7/1899 | Terry | 212/179 |
| 854,302 | 5/1907 | Nelson | 248/237 X |
| 2,305,202 | 12/1942 | Smith | 212/179 |
| 2,446,093 | 7/1948 | Lambert | 248/237 |
| 2,569,821 | 10/1951 | Maxeiner | 248/237 |
| 3,671,015 | 6/1972 | Sullivan | 248/237 X |
| 3,978,989 | 9/1976 | Avila, Jr. | 187/2 X |
| 4,068,827 | 1/1978 | Fanning et al. | 212/179 X |
| 4,296,905 | 10/1981 | Powell | 248/237 |

FOREIGN PATENT DOCUMENTS 0318373 5/1989 European Pat. Off. ..... 182/45

*Primary Examiner*—Alvin C. Chin-Shue

*Attorney, Agent, or Firm*—Adrain D. Battison; Stanley G. Ade; Murray E. Thrift

[57] ABSTRACT

A boom assembly for mounting on the roof of the building provides a pulley which receives a cable for depending over a front edge of the building to allow lifting or lowering of materials attached to the cable. The boom assembly can be folded to a relatively small packaged arrangement for ready transportation. The boom assembly can be adjusted to accommodate different orientations of support surface for example inclined or angled roof structures. The boom arrangement includes a vertical post, a counterbalance pole extending rearwardly from the base of the post and a pair of arms extending at right angles to the counterbalance pole. A brace is connected between the top of the post and the counterbalance pole with the base extending outwardly and carrying the pulley at the outer end. A cable arrangement extends between the pulley and a rear end of the counterbalance pole. The angle of the post relative to the counterbalance pole can be adjusted in two directions and also the arms can be raised and lowered as required.

17 Claims, 4 Drawing Sheets

FOLDABLE BOOM FOR MOUNTING ON A ROOF OF A BUILDING

This invention relates to a foldable boom for mounting on the roof of a building or other raised support surface for support a support cable or the like for lifting or lowering persons or materials relative to the roof for safety and rescue, Fire departments and other persons involved in safety and rescue are occasionally involved in situations where it is necessary to lower or raise persons or materials relative to a building. In some cases a ladder of cherry picker type arrangement are available to reach the persons or materials to be transported. In other cases this is not practical due to accessibility problems or to the height from the ground. It is often desirable, therefore, that a stable structure be transported to a position on the roof of a building or another raised structure to lower a cable from the roof to the required location. For such purposes it is highly desirable that the device be foldable for ready transportation and that it be adaptable to various orientations and arrangements of the roof structure since it is intended to have the device be used in different situations.

One example of a device of this type is shown in U.S. Pat. No. 2,569,821 (Maxeiner) which shows a simple angled boom arrangement formed by a post and an inclined beam. However this device is somewhat unsatisfactory in that it does not fold very effectively for transportation and in addition it does not adjust to accommodate different roof structures.

Other examples are shown in U.S. Pat. Nos. 4,004,778 (Steinhagen), 4,130,179 (Williams), 400,121 (Schaefer from 1989) and 4,801,117 (Take) all of which relate to portable units for supporting a scaffold or window cleaning device on the roof of a relatively high building. These devices are intended only to be portable in a sense that they can be moved from one flat building to another flat building and hence a little adjustment and the need for packing in the small folded condition is less important.

Further examples are shown in U.S. Pat. Nos. 4,386,680 (Reed), 4,406,351 (Littlejohn) and 4,440,261 (Clark). Each of those patents shows the device usable as an escape device from a high building. Clark includes a simple device which clamps onto the side of the building. Littlejohn and Reed show devices in the form of basically a simple beam which is mounted on the flat roof of a building and cooperates with a structure at ground level.

None of these devices can be packaged into a relatively small structure for ready transportation and none is designed for accommodating different information and orientation of the roof structure for use in different locations.

SUMMARY OF THE INVENTION

It is one object of the present invention, therefore, to provide an improved foldable boom for mounting on the roof of a building.

According to the first aspect of the invention there is provided a foldable boom for mounting on a roof of a building comprising a main post, base means at a base end of the post for resting on the roof, support means at an upper end of the post for supporting a support cable to be suspended over an edge of the roof, counter balance means connected to the posts and extending therefrom in a direction generally transverse to the edge so so as to extend across the roof away from the edge, the base means including a pair of arms, each extending from the base end of the post in a direction transverse to the counter balance means so as to lie along the edge each on a respective side of the post, and means mounting the post for pivotal movement relative to the arms about a horizontal axis longitudinal to the counter balance means.

According to a second aspect of the invention there is provided a foldable boom for mounting on a roof of a building comprising a main post, base means at a base end of the post for resting on the roof, support means at an upper end of the post for supporting a support cable to be suspended over an edge of the roof, counterbalance means connected to the posts and extending therefrom in a direction generally transverse to the edge to so as to extend across the roof away from the edge, the base means including a pair of arms, each extending from the base end of the post in a direction transverse to the counter balance means so as to lie along the edge each on a respective side of the post, the counterbalance means including a counterbalance pole extending from the base end of the post, the counterbalance pole having a telescoping portion.

According to a third aspect of the invention there is provided a foldable boom for mounting on a roof of a building comprising a main post, base means at a base end of the post for resting on the roof, support means at an upper end of the post for supporting a support cable to be suspended over an edge of the roof, counterbalance means connected to the posts and extending therefrom in a direction generally transverse to the edge to so as to extend across the roof away from the edge, the base means including a pair of arms, each extending from the base end of the post in a direction transverse to the counterbalance means so as to lie along the edge each on a respective side of the post, the counterbalance means including a counter balance pole extending from the base end of the post, and cable means extending from an end of the counterbalance pole remote from the post and arranged to communicate forces from an upper end of the post to the remote of the counterbalance pole.

One embodiment of the invention will now be described in conjunction with accompanying drawings in which:

DETAILED DESCRIPTION

Figure 1:
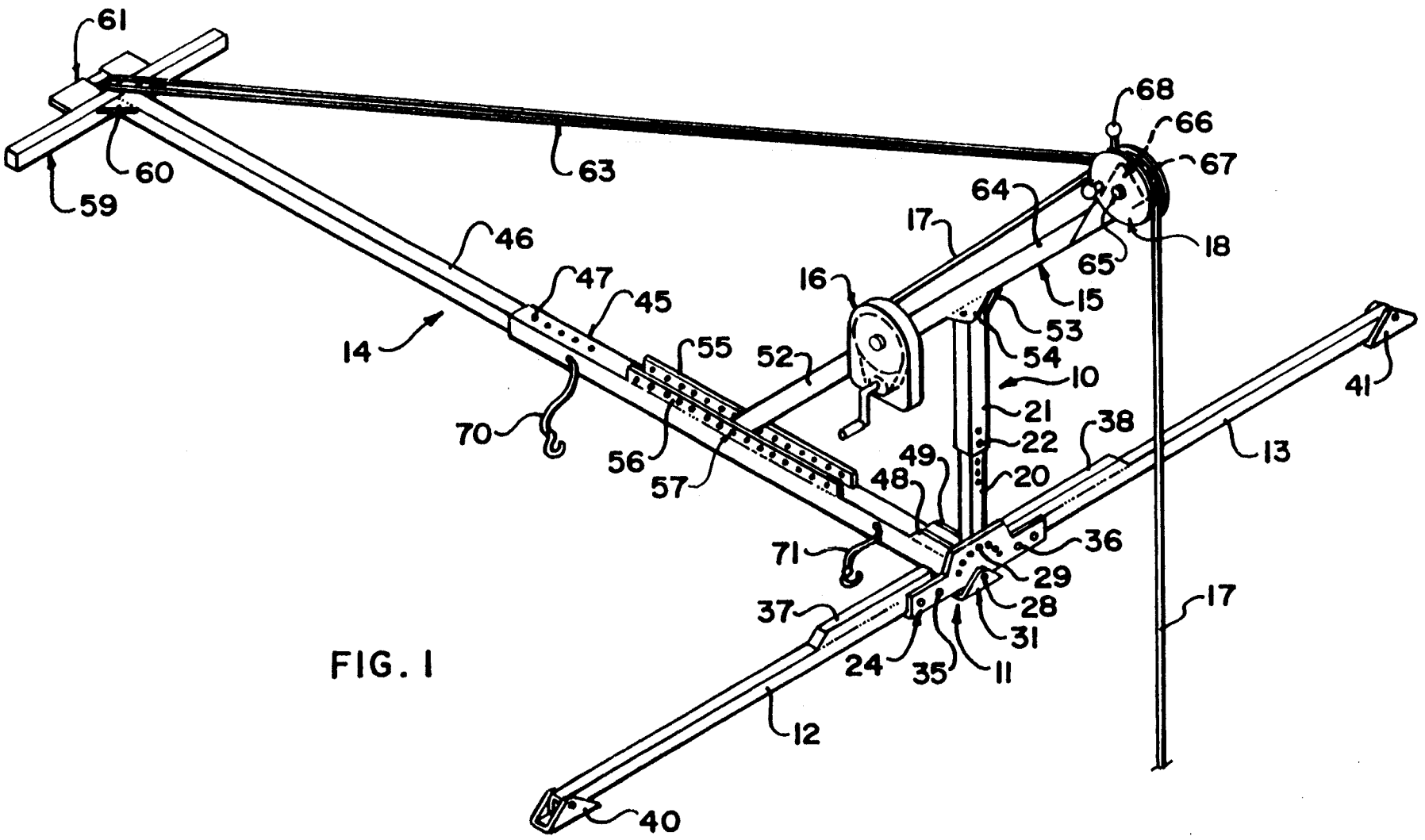
FIG. 1 is isometric view of a foldable boom according to the present invention.
Figure 2:
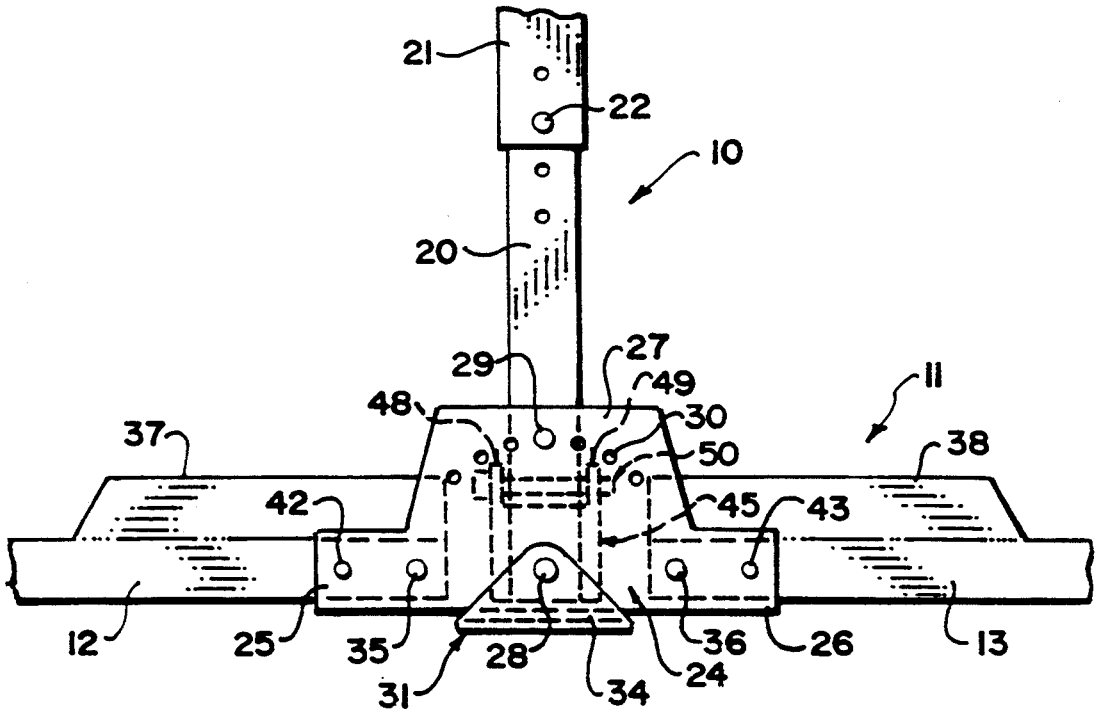
FIG. 2 is a front elevational view of a base part of the boom of FIG. 1.
Figure 5:
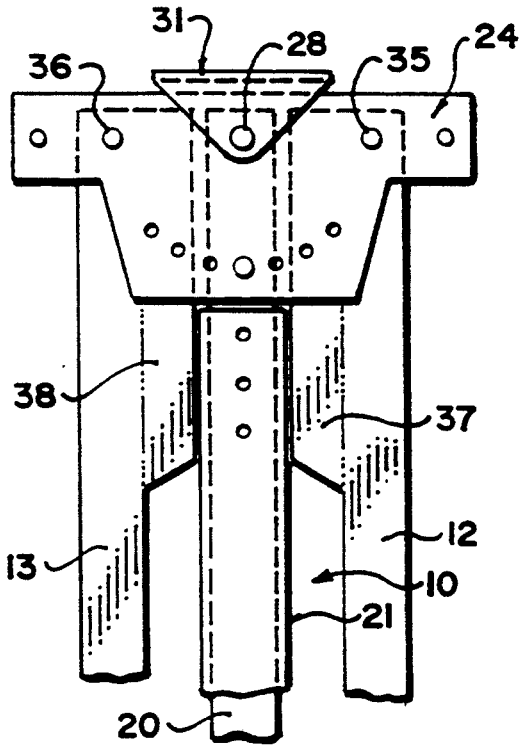
FIG. 5 is a view along the line 5—5 of FIG. 4.
Figure 3:
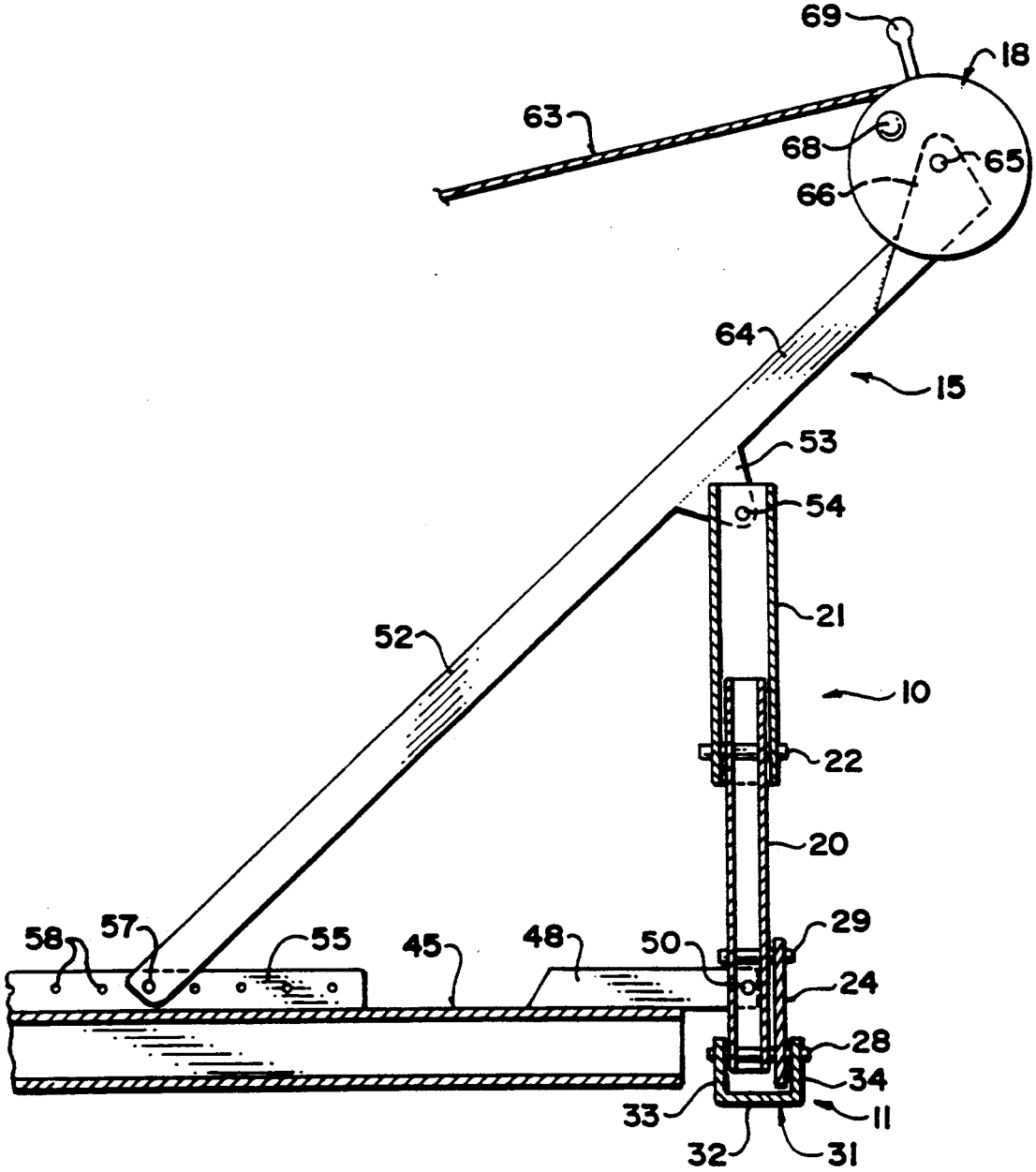
FIG. 3 is a vertical cross sectional view along a centre line of the boom of FIG. 1.
Figure 4:
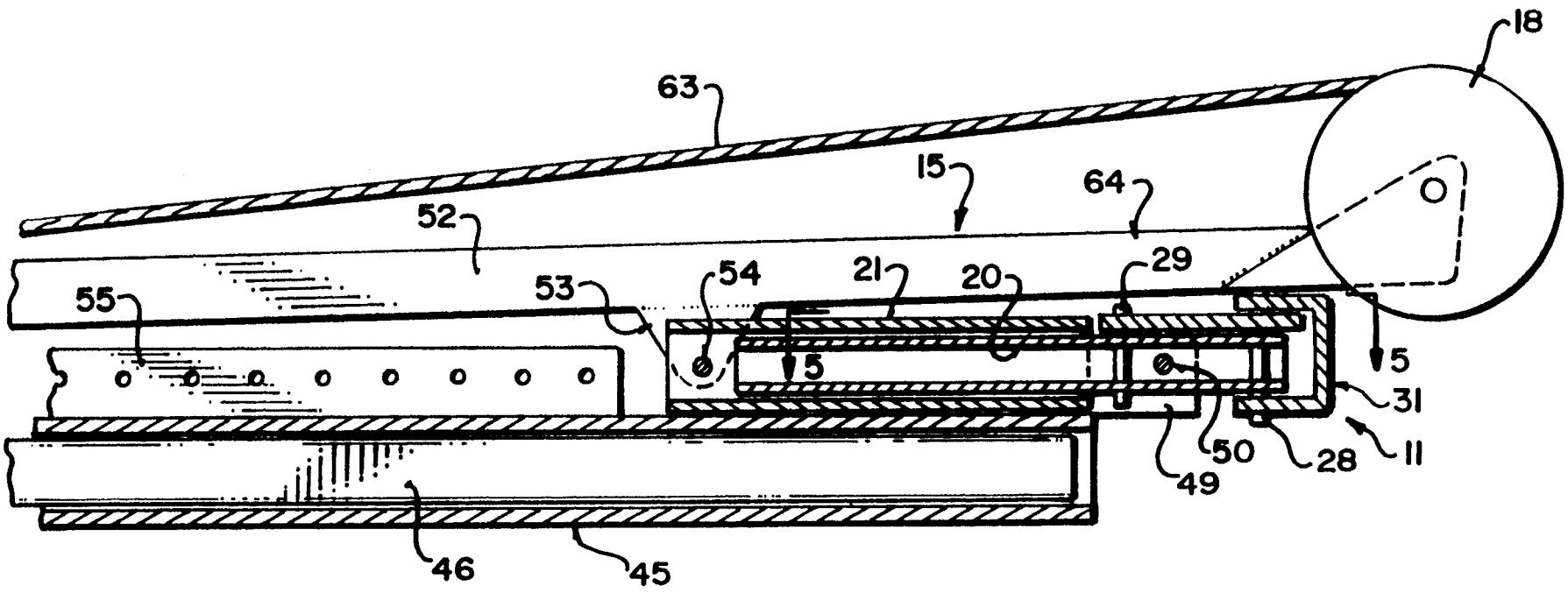
FIG. 4 is the same cross sectional view as shown in FIG. 3 but in a folded condition.

The foldable boom is shown in erected position in FIGS. 1, 2 and 3 and in a folded position in FIGS. 4 and 5. The boom comprises a main post 10, a base member 11 at a base of the post 10, a pair of stabilizing arms 12 and 13, a counter balance system 14 and a cable support 15.

As shown in the assembled condition, the intention of the device is that it can be rested upon the roof of a building with a winch 16, which is a separate element from the present invention, attached onto the device so the cable 17 from the winch can pass over a cable support or pulley 18 to be suspended over the side of the building for lifting or lowering persons or materials by support from the roof.

It is further intended that the device be foldable into a small readily portable package as explained hereinafter.

The post 10 comprises a bottom post tube 20 of square cross-section which slides inside upper post tube 21 again a square cross-section acting as a telescoping post structure, the length of which can be adjusted by selecting one of the plurality of holes for receiving a locking pin 22 between the two post tubes.

At the base of the bottom post tube is provided the base member 11 including a coupling plate 24. As best shown in FIG. 2 the coupling plate 24 stands in a vertical plane in the erected condition in a direction transverse to the length of the counter balance system. The coupling plate 24 includes a pair of horizontally extending portions 25 and 26 which extend outwardly to the sides and generally longitudinally of the arms 12 and 13 respectively. At a centre section, the coupling plate 11 forms a raised post engaging portion 27. The post is coupled to the coupling plate by a pin 28 which lies at right angles to the coupling plate and extends between the base of the post and a lower of the coupling plate at a position midway across the coupling plate. The pin carries the post and the coupling plate and allows pivotal movement of both about the pin so that the post can rotate about the horizontal axis defined by the pin 28 relative to the coupling plate. The post is attached to the coupling late by a second pin 29 passing through the post at a position spaced upwardly from the bottom pin 28. The pin 29 passes through one of a plurality of holes 30 in the raised portion 27 of the coupling plate and these holes 30 lie on an arc surrounding the axis of the pin 28. Thus the post can be rotated about the pin 28 and its orientation relative to the coupling plate adjusted by selecting one of the holes 30. In the arrangement shown the hole selected is directly above the pin 28 so that the post extends at right angles to the side portion 25 and 26 of the coupling plate. However it will be appreciated that the angle of the post can be adjusted relative to the coupling plate so the coupling plate can tilt to one side.

Also on the pin 28 is mounted a foot 31 including a base plate 32 and a pair of upstanding triangular flanges 33 and 34 which receive the pin 28 adjacent an upper central apex of the flanges. The base 32 of the foot can therefore sit on the ground supporting the pin 28 and thus the post above the ground.

Each of the arms 12 and 13 is coupled to the coupling plate by a respective one of a pair of pins 35 and 36 which extend through an end of the arm adjacent the post and through the plate 24 in a direction parallel to the pin 28. Each of the arms 12 and 13 comprises a main rectangular tube with a reinforcing tube 37, 38 welded to the top of the main tube commencing at the inner end and extending part way along the main tube. At an outer end of each of these arms is provided a further foot 40, 41 identical to the central foot and each thus including a base plate which sits on the ground and a pair of upstanding flanges which are coupled to the end of the arm for pivotal movement about an axis transverse to the arm. As shown in FIG. 1 in the erected state, the three feet of the device rest on the ground or support surface at spaced positions across the front of the device.

The mounting pins 35 and 36 allow the arms to pivot about the horizontal axis defined by the respective pin. In the position shown in FIG. 1, the arms extend in the horizontal direction directly outwardly along the side portions 25 and 26. In this position the arms can be locked by engaging a pin through a locking hole 42 or 43. However the arms can also be pivoted upwardly or downwardly to accommodate different orientations of the support surface. In addition the arms can be moved upwardly to a position directly lying along side the post in the folded position as shown and described hereinafter.

The counter balance member 14 comprises a first tubular beam 45 within which a slidable second telescopic tubular beam 46 both of which are square cross-section. The position of the beam 46 within the beam 45 can be selected by cooperating holes and a locking pin as indicated at 47.

As shown best in FIG. 3, at the end of the beam 45, adjacent the post is provided a pair of flanges 48 and 49. These flanges stand vertically upwardly from the top surface of the beam 45 and are spaced apart so they are arranged at edges of the beam 45. The flanges include portions which extend outwardly beyond the end of the beam 45 at which is provided a transverse pin 50 extending across between the two flanges and receiving the post therebetween. Thus the post carrying the coupling plate 24 and the arms can pivot about the axis of the pin 50 from the erected position shown in which the post lies at right angles to the beam 45. The pivotal movement provides adjustment of the angle of the post relative to the beam from the vertical position on either side of the vertical as required. In addition the post can fold to a horizontal position as described hereinafter.

The orientation of the post relative to the beam is fixed by a brace which is coupled to the top of the post by a pair of flanges 53 and a transverse pin 54. The brace extends from the top of the post downwardly and longitudinally of the beam 45 to a coupling position along the length of the beam 45. The brace is coupled to the beam by a pair of upstanding flanges 55 and 56 which lie parallel along the length of the top surface of the beam 45 and spaced to opposite side edges of the top surface, A pin 57 extends between the flanges and receives the lower end of the brace 52 therebetween. The flanges are provided with a plurality of adjustment holes 58 which allow the position of the brace to be selected thus adjusting the angle of the post relative to the beam 45.

At a rear end of the beam 46 is provided a T-bar 59 which is attached to the outer or rear end of the beam 46. The T-bar is braced by gussets 60 and receives a rear plate 61 allowing a weight to be placed on the T-bar to hold the outer end of the counter balance beam against the support surface. In an emergency situation, the weight can be provided simply by one of the rescue personnel who simply stands on the T-bar. The telescopic action of the counter balance beam allows the T-bar to be moved outwardly from the post to a length sufficient to provide mechanical advantage to enable relatively light weight to counter balance relatively heavy weight support on the cable 17.

A counter balance cable 63 extends from the pulley 18 to the T-bar 59 and back to the pulley. In the erected position shown in FIG. 1, the cable 63 is tensioned by actuating the pulley 18 to reel in sufficient of the cable to pull the cable tight. The cable thus communicates forces from the main post and the cable support system to the outer end of the counter balance thus reducing cantilever forces at the post.

The pulley 18 providing the support for the cable 17 is mounted at an outer end of the brace 52. Thus the brace 52 extends from the beam 45 upwardly and forwardly to the top end of the post and extends from that position outwardly in a further portion 64 of the brace cantilevered outwardly beyond the post. Thus the pulley is supported forwardly of the post as best shown in FIG. 3 so that when the post at the edge of the building the pulley is held out beyond the edge to allow the cable 17 to freely depend along the front face of the building. The pulley is mounted on a transverse pulley axle 65 which is carried on a pair of flanges 66, 67 mounted on either side of the brace portion 64. The pulley axle 65 is horizontal and at right angles to the length of the counter balance beam.

The pulley 18 constitutes a double pulley arrangement mounted on the axle 65. The first part of the pulley assembly acts to reel in the cable 63. For this purpose the pulley includes a handle 68 that can be manually grasped and rotated to reel in the cable 63 to the required length. The cable 63 thus includes one end attached to a fixed position at the pulley and the next end to a loop to the T-bar 59 and from the T-bar back to the pulley. Rotation of the pulley therefore reels in the free end of the cable so that it is pulled from a free end out of a loop. A locking device 69 can be manually actuated to lock the pulley at the required position after the required amount of the cable 63 is reeled in. The second part of the pulley simply comprises a loose pulley sheave which receives the cable 17 and allows that to rotate relative to the axle 65 and of course relative to the fixed pulley part holding the cable 63.

An initial folded position of the device is shown in FIGS. 4 and 5 in which (FIG. 5) each of the arms 12 and 13 is folded inwardly about the respective pin 35, 36 so as to lie parallel to the post 10. At the same time the post is collapsed by extracting the pin 22 and causing the upper post portion 21 to slide downwardly.

As shown in FIG. 4, the collapsed post with the arms 12 and 13 and the coupling plate 11 are then pivoted about the pin 50 on the flanges 49. In order to achieve this pivotal action the lower end of the brace 52 is released from the flanges 55 and 56 so that the brace can slide along the beam portion 45 of the counter balance beam 14. The reel 16 is removed at this stage as this does not form part of the boom construction.

It will be noted that the length of the portion 64 of the brace 52 is substantially equal to the height of the post. Also the length of the brace is substantially equal to the length of the beam portion 45 and to the length of the arms. Thus in the folded condition the post extends from the coupling plate part way along the beam portion 45 and the portion 64 of the brace extends from the pin 54 back to the coupling plate 11. The length of the brace is substantially equal to the length of the beam portion 45 which is turn substantially equal to the length of the arms 12 and 13. Thus each of these elements extends from the coupling plate to a common end position at the end of the beam portion 45. The beam portion 46 is collapsed inside the beam portion 45 in telescopic manner. During this folding action the cable 63 is drawn onto the pulley 18 and locked in place. In its folded position, the assembly can be wrapped with elastic cords 70 and 71 which are attached to the beam portion 45, looped around the elements and then coupled back to the beam portion 45 to hold the structure in the solid condition.

Movement to the erected condition is effected by pivoting the post about the pin 50 and by releasing the arms to the outer position as shown in FIG. 1. When resting on a flat horizontal surface, the device takes the position shown in FIG. 1. The post is raised, the cable is tensioned and the structure is ready for receiving the winch 16 and the cable 17 for raising or lowering the intended materials.

In the event that the device is positioned on a roof surface that is inclined upwardly away from the front edge along the counter balance beam, the angle of the post can be adjusted by moving the brace 52 along the beam portion 45 to maintain the post vertical despite the fact that the counter balance beam is inclined upwardly. Similar adjustment in the opposite direction can be effected in the event that the end of the counter balance beam on the roof structure is lower than the lower end of the post. In addition the post can be moved side to side by pulling and relocating the pin 29 to accommodate an inclination side to side along the length of the arms. In the event that the device is positioned at the base or apex of a v-shaped roof structure, one of the arms can be pivoted upwardly or downwardly about its respective pin while other of the arms is attached to the coupling plate by the locking pin 24. The device therefore can accommodate various orientations of roof structure by these various adjustments while supporting the pulley 18 out over the edge of the roof for receiving the cable 17 and allowing that cable to depend vertically downwardly along the front face of the building.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A foldable boom for mounting on a roof of a building comprising a main post, base means at a base end of the post for resting on the roof, support means at an upper end of the post for supporting a support cable to be suspended over an edge of the roof, counter balance means connected to the posts and extending therefrom in a direction generally transverse to the edge so as to extend across the roof away from the edge, the base means including a base coupling member and a pair of arms, each arm extending from the base end of the post in a direction transverse to the counter balance means and each arm being connected to the base coupling member for pivotal movement relative thereto about a horizontal axis transverse to the respective arm so as to be foldable from a first position in which the arms lie along the edge each on a respective side of the post to a second position in which the arms lie alongside the post, means mounting the post on the base coupling member for pivotal movement relative to the base coupling member and relative to the arms about a horizontal axis longitudinal to the counter balance means and means for locking the post at each of a plurality of predetermined angles relative to the base coupling member.

2. The foldable boom according to claim 1 wherein the base coupling member comprises an end plate on the side of the post adjacent the edge and including a pair of outwardly extending plate portions and a central raised section, the central raised section having means thereon for engaging the post at predetermined adjustable angles of the post.

3. The foldable boom according to claim 1 including an outer foot member arranged at an outer end of each of the arms and pivotal relative to the respective arm about a horizontal axis transverse to the arm and a central foot member mounted on the base end of the post and pivotal relative to the base end of the post about a horizontal axis parallel to the axis of the outer foot members.

4. The foldable boom according to claim 1 including means mounting the arms and the posts relative to the counter balance means such that the counter balance means can be folded to a position parallel to and along side the post and the arms.

5. The foldable boom according to claim 1 wherein the counter balance means includes a counter balance pole extending from the base end of the post.

6. The foldable boom according to claim 5 wherein the counter balance pole includes a telescoping portion.

7. The foldable boom according to claim 5 including bracing cable means extending from an end of the counterbalance means remote from the post and arranged to communicate forces from an upper end of the post to the remote end of the counterbalance pole.

8. The foldable boom according to claim 7 wherein the bracing cable means extends to the support means.

9. The foldable boom according to claim 8 wherein the support means includes a pulley thereon for receiving the support cable, the bracing cable means extending from the counter balance pole to the pulley.

10. The foldable boom according to claim 7 wherein the support means includes a brace member extending from the upper end of the pole downwardly and outwardly longitudinally of the counter balance pole and connected to the counter balance pole at a position thereon part way therealong and extending from the upper end of the pole in a direction opposite to the counter balance pole to support the support cable at an outer end thereof on the side of the post remote from the counter balance pole.

11. A foldable boom for mounting on a roof of a building comprising a main post, base means at a base end of the post for resting on the roof, support means at an upper end of the post for supporting a support cable to be suspended over an edge of the roof, counterbalance means connected to the posts and extending therefrom in a direction generally transverse to the edge so as to extend across the roof away from the edge, the base means including a pair of arms, each extending, in a first erected position thereof, from the base end of the post in a direction transverse to the counter balance means so as to lie along the edge each on a respective side of the post and each being movable to a second folded position thereof lying alongside the post, the counterbalance means including a single counterbalance pole extending from the base end of the post and bracing cable means extending from an end of the counterbalance pole remote from the post and arranged to communicate forces from an upper end of the post to the remote end of the counterbalance pole, the counterbalance pole having a telescoping portion and being foldable from a first erected position thereof extending outwardly from the post to a second folded position thereof lying alongside the post.

12. The foldable boom according to claim 11 wherein the bracing cable means extends to the support means.

13. The foldable boom according to claim 12 wherein the support means includes a pulley thereon for receiving the support cable, the bracing cable extending from the counterbalance pole to the pulley.

14. The foldable boom according to claim 11 wherein the support means includes a brace member extending from the upper end of the pole downwardly and outwardly longitudinally of the counterbalance pole and connected to the counter balance pole at a position thereon part way therealong and extending from the upper end of the pole in a direction opposite to the counterbalance pole to support the support cable at an outer end thereof on the side of the post remote from the counterbalance pole.

15. A foldable boom for mounting on a roof of a building comprising a main post, base means at a base end of the post for resting on the roof, support means at an upper end of the post for supporting a support cable to be suspended over an edge of the roof, counterbalance means connected to the posts and extending therefrom in a direction generally transverse to the edge so as to extend across the roof away from the edge, the base means including a pair of arms, each extending from the base end of the post in a direction transverse to the counterbalance means so as to lie along the edge each on a respective side of the post, the counterbalance means including a counter balance pole extending from the base end of the post, and cable means extending from an end of the counterbalance pole remote from the post and arranged to communicate forces from an upper end of the post to the remote of the counterbalance pole, wherein the support means includes a brace member extending from the upper end of the post downwardly and outwardly longitudinally of the counterbalance pole and connected to the counter balance pole at a position thereon part way therealong and extending from the upper end of the post in a direction opposite to the counterbalance pole to support the support cable at an outer end thereof on the side of the post remote from the counterbalance pole.

16. The foldable boom according to claim 15 wherein the support means includes a pulley thereon for receiving the support cable, the bracing cable extending from the counterbalance pole to the pulley.

17. A foldable boom for mounting on a roof of a building comprising a main post, base means at a base end of the post for resting on the roof, support means at an upper end of the post for supporting a cable to be suspended over an edge of the roof, counter balance means connected to the posts and extending therefrom in a direction generally transverse to the edge so as to extend across the roof away from the edge, the base means including a pair of arms, each extending from the base end of the post in a direction transverse to the counter balance means so as to lie along the edge each on a respective side of the post, the counter balance means including a counter balance pole extending from the base end of the post, and means mounting the arms and the counter balance pole for pivotal movement relative to a base of the post such that the arms and counter balance pole extend outwardly from the post in a first erected position thereof and lie side by side in parallel condition when folded into a second folded position thereof, and a bracing cable extending from the counterbalance pole to the support means, wherein the support means includes a pulley thereon with the bracing cable extending from the counterbalance pole to the pulley and the pulley being rotatable to reel in and pay out the bracing cable for movement of the counterbalance pole between the first erected position and the second folded position thereof.

* * * * *